US008820904B2

(12) United States Patent
Aldrich et al.

(10) Patent No.: US 8,820,904 B2
(45) Date of Patent: Sep. 2, 2014

(54) AIR REMOVAL AND INK SUPPLY SYSTEM FOR AN INKJET PRINTHEAD

(75) Inventors: Charles Stanley Aldrich, Nicholasville, KY (US); Bradley Kent Drews, Lexington, KY (US); Gregory Thomas Webb, Lexington, KY (US)

(73) Assignee: Funai Electric Co., Ltd., Osaka (JP)

( * ) Notice: Subject to any disclaimer, the term of this patent is extended or adjusted under 35 U.S.C. 154(b) by 246 days.

(21) Appl. No.: 13/417,657

(22) Filed: Mar. 12, 2012

(65) Prior Publication Data

US 2013/0233418 A1 Sep. 12, 2013

(51) Int. Cl.
*B41J 2/18* (2006.01)

(52) U.S. Cl.
USPC ..... 347/89; 347/65; 347/85

(58) Field of Classification Search
USPC ..... 347/7, 89, 92, 65, 85
IPC ..... B41J 2/19,2202/07
See application file for complete search history.

(56) References Cited

U.S. PATENT DOCUMENTS

| | | | | |
|---|---|---|---|---|
| 4,195,682 | A | 4/1980 | Miller | |
| 5,113,199 | A | 5/1992 | Chan | |
| 5,600,358 | A | 2/1997 | Baldwin | |
| 6,280,024 | B1 | 8/2001 | Miyazawa | |
| 6,494,568 | B2 | 12/2002 | Hou | |
| 7,097,274 | B2 | 8/2006 | Mantooth | |
| 7,334,883 | B2 | 2/2008 | Campillo | |
| 7,988,265 | B2 | 8/2011 | Smith | |
| 8,172,376 | B2 * | 5/2012 | Nathan et al. | 347/85 |
| 2002/0047882 | A1 * | 4/2002 | Karlinski et al. | 347/85 |
| 2009/0147041 | A1 | 6/2009 | Karppinen | |

* cited by examiner

*Primary Examiner* — Lam S Nguyen

(74) *Attorney, Agent, or Firm* — Amser, Rothstein & Ebenstein LLP

(57) ABSTRACT

A microfluid ejection system includes a fluid path having proximate and distal ends, the proximate end having an inlet to receive fluid from a fluid supply, a vacuum chamber for suctioning of air from both the proximate and distal ends of the fluid path, and a pre-ejection chamber disposed in the fluid path between a proximate end and a distal end. The pre-ejection chamber includes a ceiling inclined upward toward each of the proximate and distal ends from a low point to direct air toward either the proximate or distal end for suctioning from the pre-ejection chamber. The microfluid system further includes a first and second air chambers disposed respectively at the proximate and distal ends of the fluid path to receive and direct air to the vacuum chamber.

21 Claims, 4 Drawing Sheets

AIR REMOVAL AND INK SUPPLY SYSTEM FOR AN INKJET PRINTHEAD

FIELD OF THE DISCLOSURE

The present disclosure relates generally to micro-fluid applications, such as inkjet printing. The present disclosure relates particularly to an air removal and ink supply system for a printhead of an inkjet printer having a remote or off-carrier ink supply.

BACKGROUND

The art of printing images with micro-fluid technology is relatively well-known. In thermal inkjet printing technology, thermal inkjet printers apply ink to a print medium by ejecting small droplets of ink from an array of nozzles located in a printhead. An array of thin-film resistors on an integrated circuit on the printhead selectively generates heat as current is passed through the resistors. The heat causes ink contained within an ink reservoir adjacent to the resistors to boil and be ejected from the array of nozzles associated with the resistor array. A printer controller determines which resistors will be "fired" and the proper firing sequence thus controlling the ejection of ink through the printhead so that the desired pattern of dots is printed on the medium to form an image.

For the ink supply, ink in thermal inkjet printers using an on-carrier ink supply system may be contained in printhead cartridges which include integrated ink reservoirs. The printhead cartridges are mounted on the carriage which moves the printhead cartridges across the print medium. The ink reservoirs often contain less ink than the printhead is capable of ejecting over its life. Printhead cartridges, together with the printhead, are replaced when the ink is depleted. However, the useful lifetime of a printhead can be extended significantly if the integrated ink reservoir can be refilled. Several methods now exist for supplying additional ink to the printhead after the initial supply in the integrated reservoir has been depleted. Most of these methods involve continuous or intermittent siphoning or pumping of ink from a remote ink source to the print cartridge. The remote ink source is typically housed in a replacement ink tank which is "off-carrier," meaning it is not mounted on the carriage which moves the printhead cartridge across the print medium. In an off-carrier ink supply system, the ink usually travels from the remote ink tank to the printhead through a flexible conduit.

In an off-carrier ink supply system, air inadvertently enters the printhead reservoir with the ink. Air bubbles containing liquid vapor are formed spontaneously through cavitation or nucleation during the printing operation. Air is also entrained during ejection of ink through the nozzles. Air along the ink path and those trapped in the pre-ejection chamber or via are among the major problems in inkjet printing. Air bubbles grow by rectified diffusion and eventually interfere with the flow of fluid to the nozzles, leading to a breakdown of the jetting process.

For the printhead to operate properly, air must be periodically removed. Among the known methods of removing air is to attach a vacuum source to the printhead to suck air from the fluid supply line through a vent. The vent allows air to pass through but not liquids. In removing air in the pre-ejection chamber or via, a suction cap and pump are engaged to periodically remove air from the printhead through the nozzles. This method is known as priming. During priming, air is sucked through the nozzle. When removing the air during priming, a certain amount of ink is inadvertently sucked in the process. During every cap suction process significant quantities of ink is wasted. This results in poor ink use efficiency. As the length of nozzle arrays becomes longer, the pre-ejection chamber or via becomes longer and shallower and the volume of entrained air increases which requires frequent priming or a much bigger suction cap and pump, otherwise, entrained air accumulates and could be trapped in the pre-ejection chamber and could choke off the ink flow to the nozzles of the printhead. Frequent priming or a much bigger suction cap and pump result in increased volume of waste ink.

Accordingly, a need exists in the art for a microfluid ejection system which effectively removes air from the printhead and also improves ink use efficiency.

SUMMARY

The above-mentioned and other problems become solved with an improved microfluid ejection system designed for an inkjet printhead having longer nozzle arrays.

The micro-fluid ejection system of the present disclosure includes a fluid path having proximate and distal ends, a vacuum chamber in fluid communication with the fluid path which allows suctioning of air from both the proximate and distal ends of the fluid path, a pre-ejection chamber which is disposed in the fluid path between the proximate and distal ends, and an air collecting column which is disposed at the distal end of the fluid path between the pre-ejection chamber and the vacuum chamber. The pre-ejection chamber includes a ceiling having a low point. A first portion of the ceiling declines from a fluid entry port toward the low point to direct the fluid toward the nozzle. A second portion of the ceiling inclines from the low point toward the distal end of the fluid path to direct air toward the distal end of the fluid path and to keep the air away from the downward flow of the fluid. The air collecting column collects air from the pre-ejection chamber and prevents air from being pulled back downward toward the nozzle.

The micro-fluid ejection system may also include a fluid filter, a first air chamber disposed along the fluid path, and a second air chamber disposed at the distal end of the fluid path. The fluid filter removes particles from the fluid flowing toward the pre-ejection chamber. The first air chamber collects air from the proximate end of the fluid path before the filter and directs the air toward the vacuum chamber through a first vent. The second air chamber receives air from the air collecting column and directs air toward the vacuum chamber through a second vent.

A proximate sidewall of the pre-ejection chamber inclines upward toward the fluid entry port to direct fluid toward a proximate side of the pre-ejection chamber while a distal sidewall inclines upward toward the second air chamber to direct air toward the air collecting column.

Air bubbles that accumulate in the pre-ejection chamber are moved by the natural flow of ink and buoyancy and by the suctioning effect of the vacuum chamber toward either the proximate end or the distal end of the fluid path. With the configuration of the pre-ejection chamber, fluid is directed to the entire length of the nozzle with the air bubbles directed toward the first air chamber or the second air chamber. With the present disclosure, air bubbles are removed from the printhead through the first and second vents.

BRIEF DESCRIPTION OF THE DRAWINGS

The accompanying drawings incorporated in and forming a part of the specification, illustrate several aspects of the present disclosure, and together with the description serve to explain the principles of the present disclosure. In the drawings.

DETAILED DESCRIPTION OF THE ILLUSTRATED EMBODIMENTS

In the following detailed description, reference is made to the accompanying drawings where like numerals represent like details. The embodiments are described in sufficient detail to enable those skilled in the art to practice the present disclosure. It is to be understood that other embodiments may be utilized and that process, electrical, and mechanical changes, etc., may be made without departing from the scope of the present disclosure. The following detailed description, therefore, is not to be taken in a limiting sense and the scope of the present disclosure is defined only by the appended claims and their equivalents.

Figure 1:
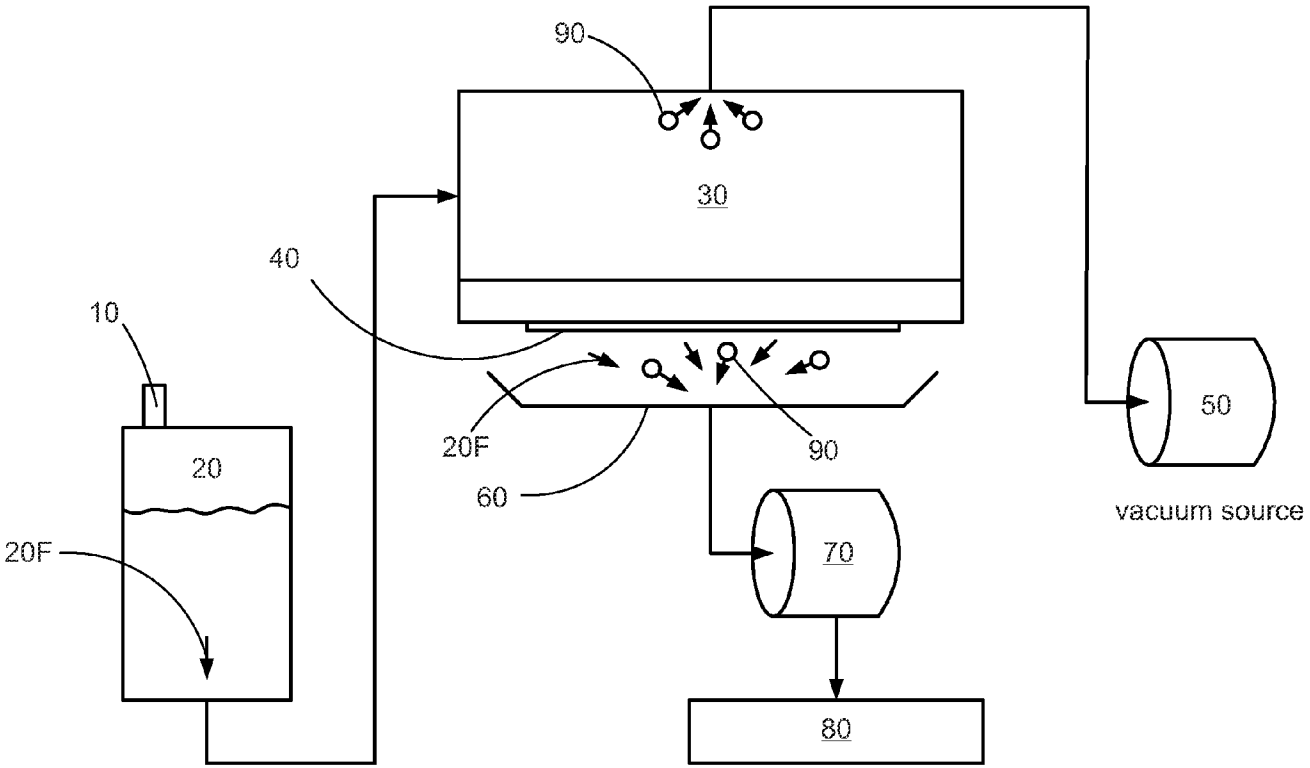
FIG. 1 is a schematic view of a typical off-carrier micro-fluid imaging device.

With reference to FIG. 1, a typical off-carrier micro-fluid ejection system is shown which consist of a fluid supply 20, including a vent 10, which supplies fluid 20F to a micro-fluid ejection head 30. The fluid supply 20 is disposed below the micro-fluid ejection head 30 to have the fluid 20F at a negative pressure compared to the micro-fluid ejection head 30. The micro-fluid ejection head 30 is connected to a vacuum source 50 which removes air 90 from the fluid 20F. The vacuum source 50 sucks air 90 from the fluid 20F. Fluid 20F entering the micro-fluid ejection head 30 is ejected through the nozzle plate 40. The micro-fluid ejection system of FIG. 1 includes a suction cap 60 connected to a pump 70. The suction cap 60 and pump 70 are used periodically to prime and remove air 90 from the micro-fluid ejection head 30. During suctioning of air 90 by the suction cap 60 and the pump 70, a certain amount of fluid 20F is also sucked and directed to a waste fluid container 80.

Figure 2:
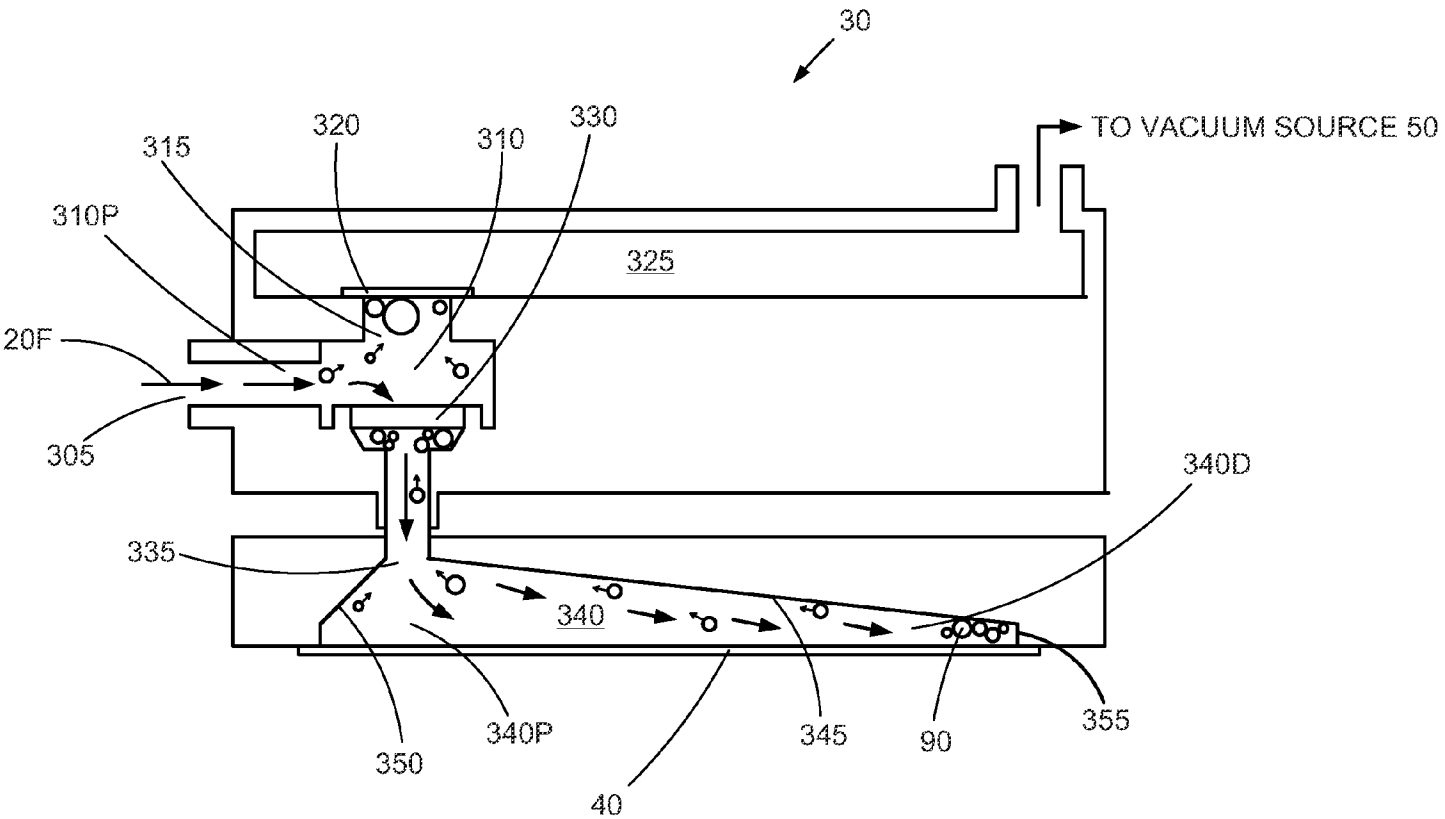
PRIOR ART Figure 2
FIG. 2 is a diagrammatic cross-section view of a typical fluid path and via of a micro-fluid ejection head.

FIG. 2 is a diagrammatic cross-section view of a typical micro-fluid ejection head 30 disclosing a fluid path 310. Fluid 20F enters the micro-fluid ejection head 30 through an inlet 305 and flows along a fluid path 310. As the fluid 20F flows along a proximate end 310P of the fluid path 310, air 90 from the fluid 20F is sucked by a vacuum source 50 and is directed toward a first air chamber 315 and into a vacuum chamber 325 through a first vent 320. The first vent 320 allows air 90 to pass through but not liquids. The fluid 20F further flows along the fluid path 310 toward a filter 330. The filter 330 removes particles from the fluid 20F as the fluid 20F passes through toward an entry port 335 of a pre-ejection chamber 340. The pre-ejection chamber 340 includes a ceiling 345, a proximate sidewall 350 and a distal sidewall 355. The ceiling 345 declines toward the distal sidewall 355 to direct fluid 20F towards a distal side 340D of the pre-ejection chamber 340. The proximate sidewall 350 inclines toward the entry port 335 to direct the fluid 20F toward a proximate side 340P of the pre-ejection chamber 340.

By buoyancy, air 90 from the pre-ejection chamber 340 moves toward the filter 330 and accumulates just below the filter 330. A portion of the air 90 accumulated below the filter 330 is sucked by the vacuum source 50. Another portion is carried by the flow of the fluid 20F toward the pre-ejection chamber 340. As the length of nozzle arrays becomes longer, the pre-ejection chamber 340 becomes longer and shallower and the volumes of air 90 in the pre-ejection chamber 340 and below the filter 330 increase and the suction force of the vacuum source 50 becomes lesser at a distal side 340D of the pre-ejection chamber 340. The increased volume of air 90 below the filter 330 obstructs the flow of the fluid 20F to the pre-ejection chamber 340. Air 90 at the distal side 340D of the pre-ejection chamber 340 is trapped due to the natural flow of the fluid 20F, the lesser effect of the vacuum source 50 and the configuration of the pre-ejection chamber 340 in the distal side 340D. Air 90 trapped at the distal side 340D of the pre-ejection chamber grows by rectified diffusion and eventually interferes with the jetting process. The air 90 accumulated below the filter 330 and the air 90 trapped at the distal side 340D are removed by suctioning or priming performed periodically by the suction cap 60 and the pump 70 as shown in FIG. 1. As further shown in FIG. 1, air 90 and a certain amount of fluid 20F are sucked during priming.

Figure 3:
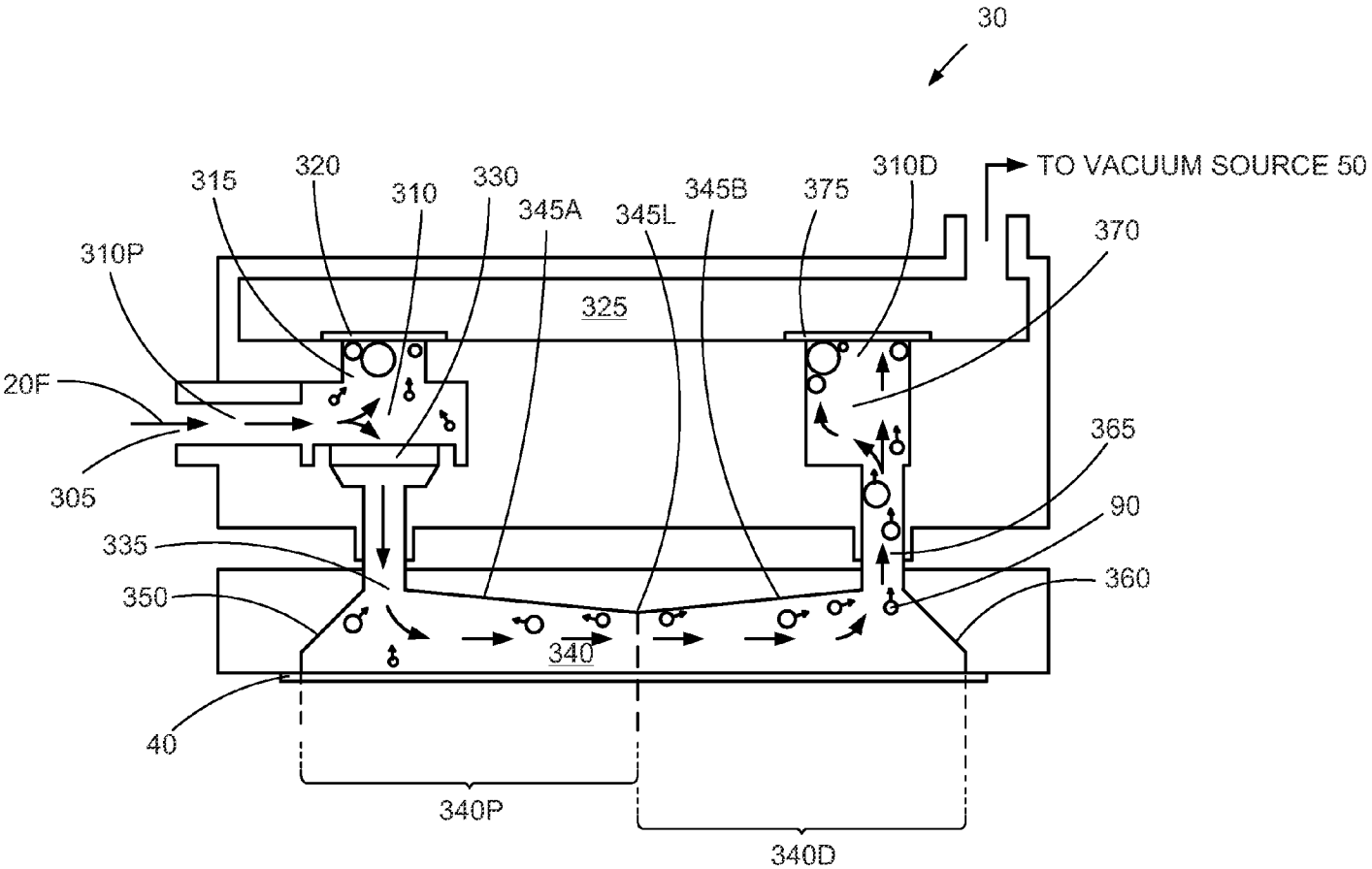
FIG. 3 is a diagrammatic cross-section view of a micro-fluid ejection head according to the present disclosure.
Figure 4:
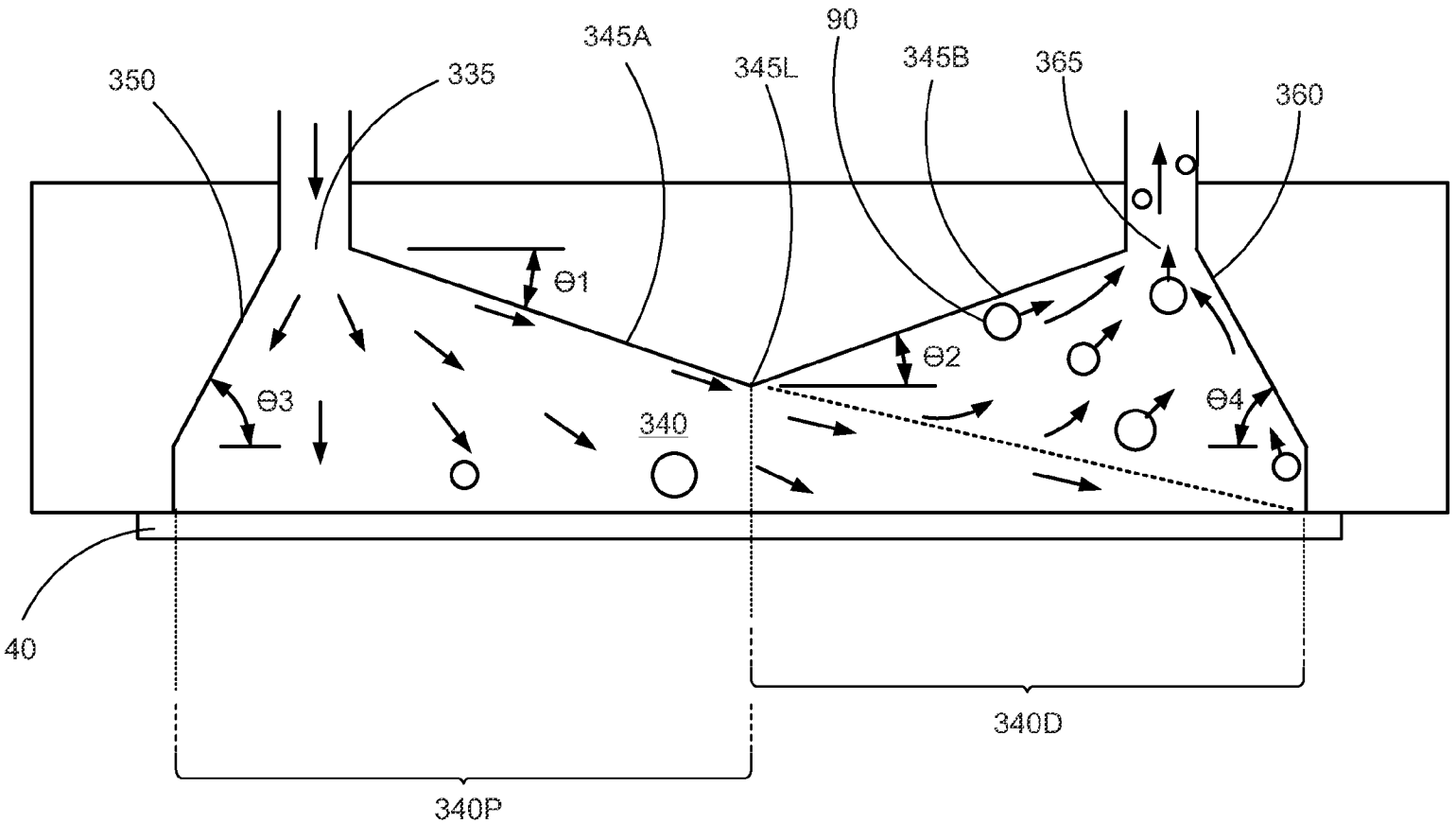
FIG. 4 is a diagrammatic cross-section view of a pre-ejection chamber according to the present disclosure.

With reference to FIGS. 3 and 4, a diagrammatic cross-section view of a micro-fluid ejection head 30 and a detailed cross-section view of the pre-ejection chamber 340 according to the present disclosure are shown. In FIG. 3, fluid 20F enters the micro-fluid ejection head 30 through an inlet 305 and flows along a fluid path 310. As the fluid 20F flows along a proximate end 310P of the fluid path 310, it is sucked by a vacuum source 50 and is directed towards a first air chamber 315. Air 90 from the fluid 20F passes through a first vent 320 and is received by a vacuum chamber 325. The first vent 320 allows air 90 to pass through but not liquids. The fluid 20F further flows along the fluid path 310 through a filter 330. The filter 330 removes particles from the fluid 20F as the fluid 20F passes through toward an entry port 335 of a pre-ejection chamber 340.

The pre-ejection chamber 340, according to the present embodiment, includes a ceiling 345, a proximate sidewall 350 and a distal sidewall 360. The proximate sidewall 350 inclines toward the air entry port 335 to direct air 90 toward the first air chamber 315. The proximate sidewall 350 also guides the flow of the fluid 20F from the entry port 335 toward a proximate side 340P of the pre-ejection chamber 340. FIG. 4 shows one example embodiment, where the proximate sidewall 350 inclines toward the entry port 335 at an angle θ3 of about 20 degrees to about 150 degrees. By buoyancy and by the suctioning force of the vacuum source 50, air 90 from the proximate side 340P of the pre-ejection chamber 340 moves toward the proximate end 310P of the fluid path 310. By the natural flow of the fluid 20F, a portion of air 90 moves from the proximate side 340P to the distal side 340D of the pre-ejection chamber 340.

The ceiling 345 includes a first portion 345A and a second portion 345B. As shown in detail in FIG. 4, the first portion 345A of the ceiling 345 declines at an angle θ1 from the entry port 335 toward a low point 345L of the ceiling 345 to direct the flow of the fluid 20F toward the nozzle plate 40. In one example embodiment, angle θ1 is about 15 degrees to about 90 degrees. In another example embodiment, the low point 345L is situated at a substantially middle portion of the ceiling 345. By the configuration of the first portion 345A of the ceiling 345, air 90 at the proximate side 340P is directed toward the entry port 335 by buoyancy and by the suctioning force from the vacuum source 50. On the other hand, the second portion 345B of the ceiling 345 inclines toward a distal end 310D of the fluid path 310 to keep the air 90 away from the downward flow of fluid 20F and from being drag toward the nozzle plate 40. In one example embodiment, as shown in FIG. 4, the second portion 345B of the ceiling 345 inclines at an angle θ2 from the low point 345L toward an air collecting column 365. In another example embodiment, angle θ2 is about 15 degrees to about 90 degrees. The configuration of the second portion 345B of the ceiling 345 directs the air 90 toward the distal end 310D of the fluid path 310. Air 90 in the distal side 340D of the pre-ejection chamber 340 is moved towards the distal end 310D of the fluid path 310 by the natural flow of the fluid 20F, by buoyancy, and by the suctioning force from the vacuum source 50.

The distal sidewall 360 of the pre-ejection chamber 340 inclines toward the distal end 310D of fluid path 310 to direct air 90 at the distal side 340D toward the distal end 310D of the fluid path 310. In one example embodiment, as shown in FIG. 4, the distal sidewall 360 of the pre-ejection chamber 340 inclines toward the air collecting column 365 at an angle θ4. In another example embodiment, angle θ4 is about 20 degrees to about 150 degrees.

As further shown in FIG. 3, Fluid 20F from the pre-ejection chamber 340 flows toward the distal end 310D of the fluid path 310 passing along the air collecting column 365. The air collecting column 365 collects air 90 from the pre-ejection chamber 340. Air 90 received by the air collecting column 365 moves toward the distal end 310D of the fluid path 310 only due to the flow of the fluid 20F at the air collecting column 365, buoyancy and by the suctioning of the vacuum source 50.

A second air chamber 370 is disposed at the distal end 310D of the fluid path 310 to hold the air 90 prior to suctioning. Air 90 received by the air collecting column 365 is directed to the second air chamber 370. From the second air chamber, air 90 is sucked by the vacuum source 50 through a second vent 375 toward the vacuum chamber 325. Similar to the first vent 320, the second vent 375 allows air 90 to pass through but not liquids.

As shown in detail in FIG. 4, fluid 20F enters the pre-ejection chamber 340 through the entry port 335. From the entry port 335, fluid 20F flows downward towards the nozzle plate 40. The flow of the fluid 20F from the entry port 335 toward the nozzle plate 40 is guided by the proximate sidewall 350 and the first portion 345A of the ceiling 345. The first portion 345A of the ceiling 345 declines from the entry port 335 toward a low point 345L of the ceiling 345 at an angle θ1 to direct the fluid 20F toward the distal side 340D of the pre-ejection chamber 340. Air 90 reaching the area near the second portion 345B is shielded from the downward flow of the fluid 20F. The air 90 reaching the area near the second portion 345B moves upward towards the air collecting column 365 due to the flow of the fluid 20F, by buoyancy and by the suctioning force from the vacuum source 50. The distal sidewall 360 of the pre-ejection chamber 340 inclines at an angle θ4 to direct the fluid 20F toward the air collecting column 365. By the suctioning force from the vacuum source 50, air 90 received in the air collecting column 365 is drawn toward the second air chamber 370 and into the vacuum chamber 325 through the second vent 375.

The foregoing illustrates various aspects of the present disclosure. It is not intended to be exhaustive. Rather, it is chosen to provide the best illustration of the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A microfluid ejection system, comprising:

a fluid path having proximate and distal ends, the proximate end having an inlet to receive fluid from a fluid supply;

a vacuum chamber in fluid communication with the fluid path to allow suctioning of air from both the proximate and distal ends of the fluid path; and a pre-ejection chamber disposed in the fluid path between the proximate end and the distal end including a ceiling inclined upward toward each of the proximate and distal ends from a low point to direct air toward either the proximate or distal end for suctioning from the pre-ejection chamber so that air can be suctioned separately from the proximate and distal ends of the fluid path.

2. The microfluid ejection system of claim 1, wherein the ceiling inclines toward the proximate end at an angle of about 15 degrees to about 90 degrees.

3. The microfluid ejection system of claim 1, wherein the ceiling inclines toward the distal end at an angle of about 15 degrees to about 90 degrees.

4. The microfluid ejection system of claim 1, wherein the low point is located at a substantially middle portion of the ceiling.

5. The microfluid ejection system of claim 1, wherein a distal sidewall of the pre-ejection chamber inclines toward the distal end to direct air bubbles to the vacuum chamber.

6. The microfluid ejection system of claim 5, wherein the distal sidewall inclines toward the distal end at an angle of about 20 degrees to about 150 degrees.

7. The microfluid ejection system of claim 1, wherein a proximate sidewall of the pre-ejection chamber inclines toward the proximate end of the fluid path to direct air bubbles towards the vacuum chamber.

8. The microfluid ejection system of claim 7, wherein the proximate sidewall inclines toward the proximate end at an angle of about 20 degrees to about 150 degrees.

9. A microfluid ejection system, comprising:

a fluid path having proximate and distal ends, the proximate end having an inlet to receive fluid from a fluid supply;

a vacuum chamber in fluid communication with the fluid path to allow suctioning of air from both the proximate and distal ends of the fluid path;

a first air chamber disposed at the proximate end to receive air at the proximate end and direct the air to the vacuum chamber;

a second air chamber disposed at the distal end to collect air at the distal end and direct the air toward the vacuum chamber; and a pre-ejection chamber disposed in the fluid path between the proximate end and the distal end, the pre-ejection chamber including, a fluid entry port disposed at a proximate side of the pre-ejection chamber below the first air chamber to receive fluid from the inlet; and a ceiling inclined upward toward each of the fluid entry port and the second air chamber from a low point to direct air toward either the first or second air chamber for suctioning from the pre-ejection chamber.

10. The microfluid ejection system of claim 9, wherein the ceiling inclines toward the fluid entry port at an angle of about 15 degrees to about 90 degrees.

11. The microfluid ejection system of claim 9, wherein the ceiling inclines toward the second air chamber at an angle of about 15 degrees to about 90 degrees.

12. The microfluid ejection system of claim 9, wherein the low point is located at a substantially middle portion of the ceiling.

13. The microfluid ejection system of claim 9, wherein a distal sidewall of the pre-ejection chamber inclines toward the second air chamber to direct air bubbles to the vacuum chamber.

14. The microfluid ejection system of claim 13, wherein the distal sidewall inclines toward the second air chamber at an angle of about 20 degrees to about 150 degrees.

15. The microfluid ejection system of claim 9, wherein a proximate sidewall of the pre-ejection chamber inclines toward the fluid entry port to direct air bubbles toward the first air chamber.

16. The microfluid ejection system of claim 15, wherein the proximate sidewall inclines toward the fluid entry port at an angle of about 20 degrees to about 150 degrees.

17. The microfluid ejection system of claim 9, wherein the second air chamber includes an air collecting column in fluid communication with the pre-ejection chamber and disposed at a distal side thereof.

18. The microfluid ejection system of claim 17, wherein the ceiling inclines toward the air collecting column at an angle of about 15 degrees to about 90 degrees.

19. The microfluid ejection system of claim 9, further including a fluid filter disposed along the fluid path above the fluid entry port of the pre-ejection chamber.

20. The microfluid ejection system of claim 9, wherein the first air chamber includes at least one vent that allows air to pass toward the vacuum chamber while restricting flow of liquid.

21. The microfluid ejection system of claim 9, wherein the second air chamber includes at least one vent that allows air to pass toward the vacuum chamber while restricting flow of liquid.

* * * * *